US007871974B2

(12) United States Patent
Somerville Roberts et al.

(10) Patent No.: US 7,871,974 B2
(45) Date of Patent: Jan. 18, 2011

(54) PROCESS FOR MAKING BLEACH PARTICLES

(75) Inventors: Nigel Patrick Somerville Roberts, Newcastle/Tyne (GB); Julie Ellis, Newcastle upon Tyne (GB); Christopher Charles Graham, Newcastle/Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 884 days.

(21) Appl. No.: 11/788,066

(22) Filed: Apr. 19, 2007

(65) Prior Publication Data

US 2007/0249510 A1 Oct. 25, 2007

(30) Foreign Application Priority Data

Apr. 20, 2006 (EP) ..... 06112851

(51) Int. Cl.
*C11D 11/00* (2006.01)
*C11D 7/26* (2006.01)
*C11D 7/54* (2006.01)

(52) U.S. Cl. ..... 510/445; 510/302; 510/375; 510/444; 510/456; 510/505; 252/186.26

(58) Field of Classification Search ..... 510/302, 510/375, 444, 445, 456, 505; 252/186.26
See application file for complete search history.

(56) References Cited

U.S. PATENT DOCUMENTS 5,716,569 A * 2/1998 Berenbold et al. ..... 264/115
5,763,378 A 6/1998 Painter et al.
6,133,216 A * 10/2000 Loffler et al. ..... 510/349
2003/0144166 A1 * 7/2003 Cramer et al. ..... 510/302
2008/0113036 A1 * 5/2008 Reinhardt et al. ..... 424/613

FOREIGN PATENT DOCUMENTS

WO WO 93/07086 A1 4/1993
WO WO 95/19132 A1 7/1995
WO WO 96/17921 A1 6/1996
WO WO 03/095598 A1 11/2003
WO WO 03/095599 A1 11/2003
WO WO 03/095602 A1 11/2003

OTHER PUBLICATIONS

International Search Report received in connection with PCT/IB2007/051311, mailed on Sep. 6, 2007, 3 pages.
U.S. Appl. No. 11/788,068, filed Apr. 19, 2007, Roberts et al.

* cited by examiner

*Primary Examiner*—Gregory R Del Cotto
(74) *Attorney, Agent, or Firm*—Julia A. Glazer; Leonard W. Lewis; Steven W. Miller

(57) ABSTRACT

A process for making bleach granules comprising a bleach selected from the group of diacyl, tetraacyl peroxide and mixtures thereof, selected from diacyl peroxides of the general formula:

$$R^1—C(O)—OO—(O)C—R^2$$

in which $R^1$ represents a $C_6$-$C_{18}$ alkyl group and $R^2$ represents an aliphatic group compatible with a peroxide moiety, such that $R^1$ and $R^2$ together contain a total of 8 to 30 carbon atoms; the tetraacyl peroxide is selected from tetraacyl peroxides of the general formula:

$$R^3—C(O)—OO—C(O)—(CH_2)n-C(O)—OO—C(O)—R^3$$

in which $R^3$ represents a $C_1$-$C_9$ alkyl group and n represents an integer from 2 to 12, wherein the process comprises the step of dry granulating the diacyl and/or tetraacyl peroxide.

11 Claims, No Drawings

PROCESS FOR MAKING BLEACH PARTICLES

TECHNICAL FIELD

The present invention relates to a process for making bleach granules comprising a diacyl and/or tetraacyl peroxide bleaching species. The process does not alter the stability of the peroxide bleaching species and produce dust free granules having excellent bleaching performance, stability and formulation compatibility, in particular with detergent compositions.

BACKGROUND OF THE INVENTION

A problem found in the field of dishwashing is the removal of coloured stains from dishware/tableware, in particular from plastic substrates which have been in contact with coloured foods. In addition, the coloured material when removed or partially removed from the stained substrate can deposit on the plastic parts of an automatic dishwashing machine.

Different solutions have been proposed to tackle the removal and deposition of coloured stains from plastic in a machine dishwashing method. WO 03/095598 relates to a process for removing coloured stains from plastic by treating the substrate in an ADW machine with an aqueous liquor having a peroxide value of 0.05 to 40 (peroxide components include terpenes). In WO 03/095599 the coloured stains from plastic are removed by treating the substrate with a composition comprising 3-phenyl-2-propenal and/or 3,7-dimethyl-2,6-octadien-1-al. WO 03/095602 presents another alternative process for removing coloured stains from plastic by treating the substrate with an aqueous composition comprising a hydrophobic component having a density in the range of 0.06 to 1 gram/cm3. Hydrophobic components include hydrocarbon oil and edible oil. Paraffin oil is the preferred hydrophobic component.

Diacyl and/or tetraacyl peroxide bleaching species may be used to inhibit the transfer of coloured/bleachable soils when employed in a laundry (WO 93/07086) or dishwashing (WO 95/19132) method. Such species are however intrinsically unstable above their melting points and are liable to self-accelerating thermal decomposition. To provide storage stability '086 and '132 propose the incorporation of the diacyl and tetraacyl bleaching species as "guest" molecules in "host-guest complexes" in which the molecules of the bleaching species are individually separated from each other by their inclusion in the host receptor sites. The hosts may for example be inorganic or organic crystals having relatively open structures which provide sites that may be occupied by guest molecules, thus forming the host-guest complexes. Examples of suitable hosts include certain clathrates or inclusion compounds, including the urea clathrates and the cyclodextrins, particularly the beta-cyclodextrins. The hosts are most preferably water soluble, to enable effective release and dispersion of the bleaching species on introduction of the host-bleaching species complexes into an aqueous media, such as a wash solution. Urea clathrates of diacyl and tetraacyl bleaching species have been disclosed in both WO 93/07086 and WO 95/19132.

There is the need of less complex processes for introducing diacyl and/or tetraacyl peroxide bleaching species into detergents.

Some bleaches, in particular some acyl peroxides, are commercially available in the form of flakes and as such they could give rise to segregation issues if they are included in granular detergent compositions. This could result in a high variability of the bleach in the product and affect product performance.

Some acyl peroxides have a waxy consistency and they tend to be sticky that makes them undesirable for use in solid detergent compositions because they can give rise to agglomeration issues impairing on the flowability and dissolution of the detergent.

An added complication when dealing with bleaches, in particular some acyl peroxides, is that they can degrade thermally at low temperatures, thereby making their handling and processing complex.

The object of this invention is to provide bleach, in particular acyl peroxide bleach, in a form suitable for introduction in a detergent, in particular a granular detergent. In addition, the bleach should have good stability.

SUMMARY OF THE INVENTION

According to a first aspect of the invention there is provided a process for making bleach granules. The process comprises the step of dry granulating bleach selected from the group of acyl peroxides defined herein below. The process does not affect the thermal stability of the bleach and produces granules with improved stability and flowability when used in detergent compositions.

The process preferably does not rise the temperature of the bleach above its self-decomposition temperature. Preferably the temperature of the bleach during the process is below about 50° C., more preferably below about 40° C. and especially below about 35° C.

The bleach used in the process of the invention is selected from the group consisting of diacyl, tetraacyl peroxide and mixtures thereof, selected from diacyl peroxides of the general formula:

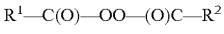

$$R^1—C(O)—OO—(O)C—R^2$$

in which $R^1$ represents a $C_6$-$C_{18}$ alkyl group and $R^2$ represents an aliphatic group compatible with a peroxide moiety, such that $R^1$ and $R^2$ together contain a total of 8 to 30 carbon atoms; the tetraacyl peroxide is selected from tetraacyl peroxides of the general formula:

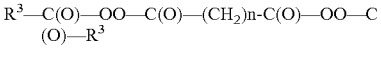

$$R^3—C(O)—OO—C(O)—(CH_2)n\text{-}C(O)—OO—C(O)—R^3$$

in which $R^3$ represents a $C_1$-$C_9$ alkyl group and n represents an integer from 2 to 12.

In preferred embodiments the bleach is selected from diacyl peroxides in which R1 and R2 are C8-C12 aliphatic groups, more preferably R1 and R2 are C11, i.e., dilauroyl peroxide. Dilauroyl peroxide provides excellent coloured stain removal, in particular from plastic substrates, as well as anti-redeposition benefits.

In preferred embodiments the bleach granules comprise at least above about 60%, more preferably at least above about 65%, especially at least above about 70% by weight thereof. The process of the invention is suitable for.granules having a high level of bleach. Granules with at least about 65%, preferably about 75% and more preferably even with at least about 90% of bleach can be made with the process of the invention. The process of the invention does not require the presence of carriers or binders, increasing the efficacy of the granule and simplifying the process and cost of making the particle.

In embodiments in which a high dispersability of the bleach is required, the bleach granule comprises a high level of solubilising agent (i.e., above about 30%, preferably above about 40% and even more preferably above about 50%). The preferred solubilising agent for these embodiments is urea.

The preferred dry granulation operation for use herein is compaction, preferably roller compaction. Roller compaction does not seem to negatively impact the stability of the acyl peroxide used herein. Other forms of compaction include tabletting, extrusion, etc. Preferably, the product obtained from the dry granulation process is subject to a size reduction operation. Granules having a particle size in the range of from about 500 μm to about 1.4 mm do not seem to give rise to segregation issues in powder detergent compositions. Preferably, the rollers of the roller compactor are coated with an inert material. Preferred inert materials for use herein include polymers, in particular rubber. Rollers made of metal may negatively interact with the acyl peroxide, the same can be said for the equipment used for size reduction.

It is preferred to use a cooling agent during the dry granulation, in particular during roller compaction. Preferred cooling agents for use herein are chilled air, i.e., air below 10° C., preferably below 5° C., liquid nitrogen or cooling water (i.e., water below 10° C., preferably below 5° C.) passed through the rollers. A cooling agent further contributes to the stability of the granule.

The stability of the granules produced according to the process of the invention can be further improved by adding a stability agent. Thus preferred embodiments include the step of mixing the bleach and stability agent and dry granulating the resulting mixture. Preferred stability agents for use herein include radical scavenger, acid buffering agent, chelant and mixtures thereof.

The bleach granule preferably comprises from about 0.01% to about 5%, more preferably from about 0.1% to about 3% and especially from about 0.2% to about 2% by weight of the particle of radical scavenger. It has surprisingly being found that a radical scavenger level above about 5% can negatively affect the stability of the bleach particle. Particles comprising a radical scavenger present high level of stability.

The invention also relates to a bleach particle obtainable according to the process of the invention and its use in detergents, in particular in granular dishwashing detergents.

DETAILED DESCRIPTION OF THE INVENTION

The present invention envisages a process for making bleach granules comprising certain acyl peroxide bleach, by using dry granulation. The process is less complex and more flexible (regarding particle composition) than other processes known in the art, such as the process for making clathrates. The process gives rise to bleach granules, having an improved stability per se as well as in product.

Many of the granulation processes used in the detergency field can be said to be "wet" or "hot" processes. They use a material in liquid form as binder for solid materials. The liquid is usually an aqueous liquid or a material in molten form. Granulation processes involving aqueous liquids may require a drying step that usually involves subjecting the product to high temperature. Granulation processes involving materials in molten form, require the contact of the molten and solid materials. These kinds of processes are not suitable for thermally instable materials such as the acyl peroxide bleach used in the process of the invention.

The process of the invention does not involve the use of high temperatures, this is critical given the thermal instability of the bleach used herein. Preferably, the process of the invention is carried out at temperatures below about 50° C., more preferably below about 40° C. and especially below about 30° C. Preferably, the process of the invention does not require a heating step. It is also preferred that the process of the invention does not involve a temperature rise of the acyl peroxide of more than about 20° C., more preferably more than about 10° C.

It is also preferred that the process of the invention does not require the use of a liquid binder, this contributes to the stability of the resulting granules.

The granules of the process of the invention may contain only the bleach or the bleach in combination with other solid components, for example, stability agents and/or process aids. If the granules contain bleach and other solid components, the bleach and other solid components are preferably pre-mixed to form a homogeneous mixture, preferably the mixing takes place in a mixing unit (e.g. plowshare mixer, tumbling drum mixer, KM Lodige, etc), the mixing unit can have grinding facilities to improve the degree of mixture of the solid components with the bleach. Alternatively, the bleach and other solid components can be directly feed into a compaction unit. In a second step, the bleach (in the case of bleach only granules) or mixture is compressed to give relatively large particles. Devices suitable for this purpose include roller compactors. The compacts are then subjected to comminution and comminuted to the desired particle size. The material with particle sizes outside the desired limits is separated off and returned to the compactor together with fresh bleach/mixture to be compacted.

Suitable equipment for use herein includes the Chilsonator® Roll Compactor, in particular Model IR520. The material to be compacted is forced between one fixed and one hydraulically loaded floating roll to form a "wafer" or densified sheet of material. The applied hydraulic force to the floating roll can be adjusted to vary hardness and bulk density of the resultant granule. The Fitzpatrick Chilsonator® Roll Compactor is provided with the horizontal and vertical feed screw system, so that dosing can be controlled separately from the pre-compression force. In many cases the Chilsonator® will be completed with a mill for size reduction of the compacted material and in some cases also equipment for sifting and recirculation of overs and fines.

The compaction pressure required varies depending on the desired properties of the resulting compact. Preferred pressures to use herein range from about 340 Kilopascals to about 20,500 Kilopascals, preferably from about 700 Kilopascals to about 17,000 Kilopascals and most preferably from about 10,000 Kilopascals to about 14,000 Kilopascals.

Other roller compactor suitable for use herein is the Pharmapaktor L 200/50 P, supplied by Hosokawa Bepex GmbH.

The process of the invention allows for the presence of not only the bleach but also other materials such as stability agent, strengthening agent and solubilising agent. Preferred stability agents include: radical scavenger, acid, buffering agent, chelant and mixtures thereof.

Radical Scavenger

It is believed that radical scavengers trap or scavenge radicals formed due to decomposition of the peroxide bond. This would prevent the radical from further reacting or propagating the formation of another radical (self-accelerated decomposition). Radical scavengers further contribute to the stability of detergent compositions when the bleach granule is placed therein. The stability of detergent compositions upon storage, comprising the granule of the invention, has been found to be excellent.

The bleach granule preferably comprises from about 0.01% to about 10%, more preferably from about 0.1% to about 7% and especially from about 0.2% to about 2% by weight of the particle of radical scavenger. It has surprisingly being found that a radical scavenger level above about 10% negatively affects the stability of the bleach granule. The granule of the invention presents a high level of stability.

Without wishing to be bound by theory, it is believed that there are three main mechanisms that affect the stability of the acyl bleaching species: thermal decomposition, radical induced decomposition and hydrolysis/perhydrolysis. All of them seem to generate free radicals that contribute to the self decomposition of the bleaching species. It has now been found that the presence of radical scavengers in the bleach granule contributes to improve the stability of the bleaching species in the granule and of the granule in a detergent composition. The instability of the bleach granule within a detergent composition can, inter alia, be generated by free moisture, alkalinity, acidity or the interaction with other ingredients, such as: i) other bleaches (for example percarbonate); ii) surfactants, in particular alkoxylated surfactants; iii) metal cations, which can be part of a bleach catalyst or be present in the detergent as contaminants, etc.

The bleach granule obtained according to the process of the invention is white when freshly make. It has been noticed that the granule can become off white or even yellow with time. This change of colour can be avoided when using an alkoxylated benzoic acid or salts thereof and in particular 3,4,5,-trimethoxy benzoic acid. Thus, according to a preferred embodiment of the invention the bleach granule comprises an alkoxylated benzoic acid or salts thereof.

Suitable radical scavengers for use herein include substituted mono- and di-hydroxy benzenes and derivatives thereof, alkyl- and aryl carboxylates and mixtures thereof. Preferred radical scavengers for use herein include di-tert-butyl hydroxy toluene (BHT), p-hydroxy-toluene, hydroquinone (HQ), di-tert-butyl hydroquinone (DTBHQ), mono-tert-butyl hydroquinone (MTBHQ), tert-butyl-hydroxy anysole (BHA), p-hydroxy-anysol, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxyphenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2-methyl-4-hydroxy-5-t-butylphenyl) butane, tert-butyl-hydroxy-anyline, p-hydroxy anyline as well as n-propyl-gallate. Highly preferred for use herein is di-tert-butyl hydroxy toluene, which is for example commercially available from SHELL under the trade name IONOL CP® and/or tert-butyl-hydroxy anysole and/or propyl gallate.

Especially suitable for use in the granule of the invention is an alkoxylated benzoic acid or salts thereof having the general formula:

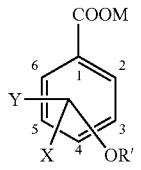

wherein: the substituents of the benzene ring X and Y are independently selected from —H, or —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, M is selected from the group consisting of hydrogen, alkali metal ions and alkaline earth metal ions. More preferably, M is selected from the group consisting of hydrogen, sodium and potassium. Even more preferably, M is hydrogen.

Said alkoxylated benzoic acid or the salt thereof can be a monoalkoxy benzoic acid or a salt thereof, wherein in the above general formula the substituents of the benzene ring X and Y are —H; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, said monoalkoxy benzoic acid or a salt thereof is selected from the group consisting of o-/m-/p-methoxy benzoic acids, salts thereof, and mixtures thereof. More preferably, said monoalkoxy benzoic acid or a salt thereof is m-methoxy benzoic acid (wherein the methoxy group is in position 3 in the above general formula) or a salt thereof.

Said alkoxylated benzoic acid or the salt thereof can be a dialkoxy benzoic acid or a salt thereof, wherein in the above general formula: the substituent of the benzene ring X is selected from —H; the substituent of the benzene ring Y is —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

Said alkoxylated benzoic acid or the salt thereof can be a trialkoxy benzoic acid or a salt thereof, wherein in the above general formula: the substituents of the benzene ring Y and X are —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

In a highly preferred embodiment of the present invention, said alkoxylated benzoic acid or the salt thereof is a trimethoxy benzoic acid or a salt thereof (TMBA), wherein in the above general formula the substituents of the benzene ring Y and X are —OR'; R' is —$CH_3$ and; M is hydrogen, a cation or a cationic moiety. Preferably, said alkoxylated benzoic acid or the salt thereof is selected from the group consisting of 3,4,5,-trimethoxy benzoic acid, a salt thereof, 2,3,4-trimethoxy benzoic acid, a salt thereof, 2,4,5-trimethoxy benzoic acid, a salt thereof and a mixture thereof. More preferably, said alkoxylated benzoic acid or the salt thereof is 3,4,5,-trimethoxy benzoic acid or a salt thereof. Even more preferably, said alkoxylated benzoic acid or the salt thereof is 3,4,5,-trimethoxy benzoic acid.

Suitable monoalkoxy benzoic acids or salts thereof are commercially available from Aldrich, in particular m-methoxy benzoic acid is commercially available from Aldrich. Suitable trimethoxy benzoic acids or salts thereof are commercially available from Aldrich and Merck.

Acid

Detergent compositions, in particular automatic dishwashing compositions, are usually alkaline, this negatively impacts on the stability of the bleach granule. It has been found that the presence of an acid in the granule improves its stability in an alkaline detergent composition. Preferably, the acid should not be detrimental for the dissolution/dispersion of the granule, more preferably the acid should improve the dissolution/dispersion of the granule. Preferred for use herein is citric acid, in particular anhydrous citric acid.

Equally, the presence of an alkali in the bleach particle might improve its stability in an acidic detergent composition.

Preferred acids for use herein include water-soluble organic mono- and polycarboxylic acids with two to six carbon atoms in the molecule and optionally substituted by one or more hydroxy groups. Suitable classes include alkanoic acids, hydroxyalkanioc acids, alkyl polycarboxylic acids and hydroxyalkyl polycarboxylic acids. Preferred herein are mono- and polycarboxylic acids which have a pKa value, related to the first dissociation stage ($pKa_1$) of no more than about 6. These include for example, adipic acid, succinic acid, tartaric acid, malic acid, maleic acid, glutaric acid, citric acid and mixtures thereof. Especially preferred for use in the particle of the invention is citric acid.

Inorganic acids and mixtures of inorganic acids and organic acids can also be used herein. Examples of inorganic acids are sulphonic acid derivatives, sulphamic acid (pKa=0.1), hydrochloric acid (pKa<0), nitric acid (pKa<0), phosphoric acid (pKa=2.1) and sulphuric acid (pKa=0.4). Suitable sulphonic acid derivatives include alkyl sulphonic acids and aryl sulphonic acids. Suitable alkyl sulphonic acids include C1-C6 linear or branched alkylsulphonic acids or mixtures thereof, such as methanesulphonic acid (pKa=1.9) commercially available for example from Aldrich, William Blythe & Co. Ltd. or Elf. Atochem.

Suitable aryl sulphonic acids for use herein include those of the formula:

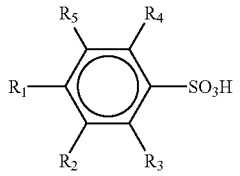

wherein R1, R2, R3, R4 and R5 are each H or $SO_3H$, or linear or branched C1-C4 alkyl chain; or mixtures thereof, the total number of C1-C4 alkyl chains preferably being no more than 2.

Preferred arylsulphonic acids to be used are those which comprise no or only one alkyl chain. Particularly suitable arylsulphonic acids for use herein are benzene sulphonic acid (pKa=0.7), toluene sulphonic acid and cumene sulphonic acid.

Preferably, the acid (or acids) is used in its lower hydration form, more preferably in anhydrous form, for stability reasons. Weak acids, i.e., acids with a pKa greater than about 1, are preferred for use herein.

Specially preferred for use herein is citric acid in granulated form, in particular anhydrous citric acid having a mean particle size (by weight) of less than about 300 μm, more preferably less than 280 μm. Especially preferred is citric acid having a mean particle size of about 250 μm.

The acid, if present in the granule of the invention, is typically incorporated at a level of from about 0.1% to about 20%, preferably from about 0.5 to about 15% and more preferably from about 1 to about 12% by weight of the granule.

Buffering Agent

It has been found highly beneficial to include in the bleach granule a pH buffering agent, preferably sodium citrate, more preferably tri-sodium citrate, which may be used in combination with an acid, preferably citric acid, to combat pH drift which might occur upon storage of the granule in a detergent composition.

Buffers are conventionally composed of weak acids and bases, which do not completely ionize in solution. A combination of sodium citrate and citric acid is the preferred buffer for the present invention, due to the presence of three carbonyl groups, resulting in three different pKa values.

The buffering agent, if present in the granule of the invention, is typically incorporated at a level of from about 0.1% to about 20%, preferably from about 0.5 to about 15% and more preferably from about 1 to about 12% by weight of the granule.

In a highly preferred embodiment, the granule obtained according to the process of the invention comprises the acyl peroxide, a radical scavenger, an acid and a buffer agent. A granule having this composition has been found extremely stable, even under extreme conditions.

Strengthening Agent

The bleach used in the process of the invention is usually in flake form, having a waxy consistency, it does not seem to be very strong mechanically. In order to reduce the make up in the compaction equipment and to enhance the handability and mechanical properties of the granule a strengthening agent can be added during the process of the invention. Silica is the preferred strengthening agent for use herein. Strengthening agents are usually in powder form. Preferred examples of strengthening agents are silica, talc, diatomaceous earth, chitosan, etc.

The strengthening agent, if present in the granule of the invention, is typically incorporated at a level of from about 0.01% to about 10%, preferably from about 0.1 to about 5% and more preferably from about 0.8 to about 4% by weight of the particle.

Solubilising Agent

By "solubilising agent" herein is meant an agent that improves the solubility/dispersability of the granules into the wash solution as compared to a particle free of the solubilising agent. For example, whether a granule component is a solubilising agent can be assessed by introducing a certain weight of granules with and without the solubilising agent, for example 1 gram, in a certain volume of water, for example 250 ml, at 40° C. The water is stirred with for example a magnetic stirrer, at 250 rpm. The two solutions (water and granules with and without solubilising agent) are filtered (using identical filters) after certain time, for example 5 minutes, preferably 1 minute and even more preferably 30 seconds, the filters are dried and residue separated and weighted, if the weight of the residue of the solution comprising the granules with the solubilising agent is less than 5%, preferably less than 10% and more preferably less than 15% than the weight of the residue of the solution comprising the granules without the solubilising agent, then the agent would be classified as solubilising agent. The filter is chosen taken into account the size of the granules, the aperture size of the filter should be less than 5%, preferably less than 10% and more preferably less than 15% of the diameter of the tested granules. The skilled person would know how to choose the right filter to evaluate if a material can be considered a solubilising agent.

A solubilising material can also be defined as that having a solubility in water at 25° C. of at least 20 grams, preferably 25 grams and more preferably 40 grams per 100 grams of water.

Examples of solubilising agents include highly water soluble salts such as sodium citrate dehydrate, potassium carbonate, urea, sodium acetate (anhydrous), sodium acetate trihydrate, magnesium sulphate 7H20, potassium acetate and mixtures thereof. Preferred for use herein as solubilising agent is urea.

A buffering agent can also act as a solubilising agent. The solubilising agent, if present in the granule of the invention, is typically incorporated at a level of from about 0.1% to about 20%, preferably from about 0.5 to about 15% and more preferably from about 1 to about 12% by weight of thegranule.

The present invention also relates to detergent and bleaching compositions comprising the diacyl and/or tetraacyl bleach granule. The compositions are preferably in solid or unit dose form, eg in powder, tablet or pouch form but can also be in liquid form. Liquid type compositions include formulations in which the liquid does not react with the bleaching species, such as anhydrous formulations. The detergent compositions are particularly useful for the removal of colour stains from hydrophobic substrates in an automatic dishwashing process in the presence of high soils. The bleaching composition can be used as additives, in combination with other detergent compositions or by themselves.

The detergent and bleaching compositions herein comprise traditional detergency components. The compositions, especially the detergent compositions, will generally be built and comprise one or more detergent active components which may be selected from colorants, additional bleaching agents, surfactants, alkalinity sources, enzymes, anti-corrosion agents (e.g. sodium silicate) and disrupting agents (in the case of powder, granules or tablets). Highly preferred detergent components include a builder compound, an alkalinity source, a surfactant, an enzyme and an additional bleaching agent. Preferably, the compositions of the invention comprise an additional bleaching agent in addition to the diacyl and/or tetraacyl peroxide. Preferably the additional bleaching agent is a percarbonate, in a level of from about 1% to about 80% by weight of the composition, in the case of a detergent composition the level is from about 2% to about 40%, more preferably from about 3% to about 30% by weight of the composition.

Co-Bleaching Surfactant

The compositions of the invention may comprise a "co-bleaching surfactant" i.e, a surfactant which helps the diacyl and/or tetraacyl bleaching species to perform its bleaching function. The ethoxylated alcohols surfactants for use herein are essentially free of alkoxy groups other than ethoxy groups.

The co-bleaching surfactant can be a single surfactant or a mixture thereof, preferably including one or more co-bleaching surfactants having a cloud point above wash temperature i.e., preferably above about 40° C., more preferably above about 50° C. and even more preferably above about 60° C. "Cloud point", as used herein, is a well known property of surfactants and mixtures thereof which is the result of the surfactant becoming less soluble with increasing temperature, the temperature at which the appearance of a second phase is observable is referred to as the "cloud point" (See KirkOthmer's Encyclopedia of Chemical Technology, 3rd Ed., Vol. 22, pp. 360-362).

Preferred co-bleaching surfactants for use herein include both liner and branched alkyl ethoxylated condensation products of aliphatic alcohols with an average of from about 4 to about 10, preferably form about 5 to about 8 moles of ethylene oxide per mol of alcohol are suitable for use herein. The alkyl chain of the aliphatic alcohol generally contains from about 6 to about 15, preferably from about 8 to about 14 carbon atoms. Particularly preferred are the condensation products of alcohols having an alkyl group containing from about 8 to about 13 carbon atoms with an average of from about 6 to about 8 moles of ethylene oxide per mole of alcohol. Preferably at least 25%, more preferably at least 75% of the surfactant is a straight-chain ethoxylated primary alcohol. It is also preferred that the HLB (hydrophilic-lipophilic balance) of the surfactant be less than about 18, preferably less than about 15 and even more less than 14. Preferably, the surfactant is substantially free of propoxy groups. Commercially available products for use herein include Lutensol®TO series, C13 oxo alcohol ethoxylated, supplied by BASF, especially suitable for use herein being Lutensol®TO7.

Amine oxides surfactants are also useful in the present invention and include linear and branched compounds having the formula:

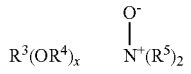

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10}$-$C_{18}$ acylamido alkyl dimethylamine oxide.

Suds Suppresser

The compositions of the invention may comprise suds suppresser. Surfactants for use as suds suppressers are preferably non-ionic surfactants having a low cloud point. As used herein, a "low cloud point" non-ionic surfactant is defined as a non-ionic surfactant system ingredient having a cloud point of less than 30° C., preferably less than about 20° C., and even more preferably less than about 10° C., and most preferably less than about 7.5° C. Typical low cloud point non-ionic surfactants include non-ionic alkoxylated surfactants, especially ethoxylates derived from primary alcohol, and polyoxypropylene/polyoxyethylene/polyoxypropylene (PO/EO/PO) reverse block polymers. Also, such low cloud point non-ionic surfactants include, for example, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of non-ionics, as described, for example, in U.S. Pat. No. 5,576,281).

Other suitable low cloud point surfactants are the ether-capped poly(oxyalkylated) suds suppresser having the formula:

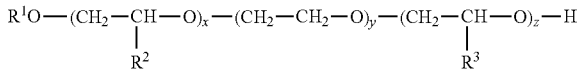

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point non-ionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

If non-ionic suds suppressers are used they are preferably used in a level of from about 5% to about 40%, preferably from about 8% to about 35% and more preferably form about 10% to about 25% by weight of the composition.

The co-bleaching surfactant, if used, is preferably used in the compositions of the invention at a level of from about 2% to about 30%, more preferably from about 4% to about 25% and even more preferably form about 3% to about 20% by weight of the composition. It is also preferred that the ethoxylated alcohols, the amine oxide surfactants and the mixtures thereof are in a level of at least about 2%, more preferably about 3% by weight of the composition. In preferred embodiments the ethoxylated alcohols are in a level above about 3%, more preferably above about 4% by weight of the composition.

EXAMPLES

TABLE 1

| | A (% wt) | B (% wt) | C (% wt) | D (% wt) |
|---|---|---|---|---|
| Dilauryl peroxide | 98.25 | 79 | 79 | 79 |
| BHT | 0.75 | 1 | 1 | 1 |
| Sodium sulphate | | 10 | | |
| Sodium citrate | | 10 | 10 | 10 |
| Citric acid | | | 10 | 10 |
| Silica | 1 | | | |

Granules having the compositions showed in table 1 where made using a Pharmapaktor L 200/50P roller compactor (available from Hosokawa Bepex GmbH). The rolls had a concave/cylindrical profile (WP 12 profile) and a working width of 5 cm.

BHT, sodium sulphate, sodium citrate and citric acid were separately ground to a mean particle size, by weight thereof, of less than about 250 μm. BHT was ground in a rotor stator mill in presence of liquid nitrogen to control the rise of temperature during the milling. The pre-ground material was mixed with the dilauryl peroxide in a tumbling drum mixer to produce compositions A to D.

Composition A was feed into the roller compactor through a screw feeder at a speed of about 100 $min^{-1}$, the mixture was compacted, using a press force of about 9 KN and a roll speed of about 10 $min^{-1}$ to produce flakes, the flakes were then transferred to a flake crusher (FC 200 with a 1.5 mm wire mesh screen) for particle reduction purposes. Afterwards, they went to a product screen that separates the fines from the product with the desired particle size (vibration screen that separated the fines from the granules at 500 μm). The fines can be re-circulated to the screw feeder. The obtained granules had a particle size of between 0.5 mm and 1.5 mm. The granules presented good flowability.

Similarly, compositions B to D were granulated. The resulting granules present good flowability and good stability.

The dimensions and values disclosed herein are not to be understood as being strictly limited to the exact numerical values recited. Instead, unless otherwise specified, each such dimension is intended to mean both the recited value and a functionally equivalent range surround that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A process for making bleach granules comprising the steps of:

pre-mixing solid components and a bleach selected from the group comprising:

(1) diacyl peroxide of the general formula:

$$R^1—C(O)—OO—(O)C—R^2$$

where $R^1$ represents a $C_6$-$C_{18}$ alkyl group and $R^2$ represents an aliphatic group compatible with a peroxide moiety, such that $R^1$ and $R^2$ together contain a total of 8 to 30 carbon atoms;

(2) tetraacyl peroxide of the general formula:

$$R^3—C(O)—OO—C(O)—(CH_2)_n\text{-}C(O)—OO—C(O)—R^3$$

where $R^3$ represents a $C_1$-$C_9$ alkyl group and n represents an integer from 2 to 12; and (3) mixtures thereof; to form a homogeneous mixture;

compressing the homogeneous mixture to form a compacted homogeneous mixture;

cooling the homogenous mixture during compression with a cooling agent;

comminuting the compacted homogeneous mixture to a bleach granule comprising a desired particle size;

wherein the temperature of the process is such that the bleach does not rise above about 10° C.;

wherein the process does not include a heating step; and wherein said mixture is free of a binder.

2. A process according to claim 1 wherein the bleach is a diacyl peroxide where $R^1$ is a $C_8$-$C_{12}$ alkyl group and $R^2$ is a $C_8$-$C_{12}$ aliphatic group compatible with a peroxide moiety.

3. A process according to claim 1 wherein the process further comprises the step of separating off the bleach granule comprising a desired particle size.

4. A process according to claim 1 wherein the compressing step comprises a roller compacting step.

5. A process according to claim 1 wherein the roller compacting step comprises forcing the homogeneous mixture between one fixed and one hydraulically loaded floating roll to form the compacted homogeneous mixture.

6. A process according to claim 5 wherein the pressure of the compacting step is from about 340 kilopascals to about 20,500 kilopascals.

7. A process according to claim 1 wherein the solid components are selected from the group comprising radical scavenger, acid, buffer agent, strengthening agent, solubilizing agent and mixtures thereof.

8. A process according to claim 7 wherein the radical scavenger is selected from substituted mono- and di-hydroxy benzenes, mono- and di-hydroxy benzenes derivatives, alkyl-carboxylates, aryl carboxylates and mixtures thereof.

9. A process according to claim 8 wherein the radical scavenger is selected from di-tert-butyl hydroxy toluene, p-hydroxy-toluene, hydroquinone, di-tert-butyl hydroquinone, mono-tert-butyl hydroquinone, ter-butyl-hydroxy anysole, p-hydroxy-anysol, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxyphenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2(methyl-4-hydroxy-5-t-butylpenyl) butane, tert-butyl-hydroxy-anyline, p-hydroxy anyline, and n-propyl-gallate.

10. A process according to claim 7 wherein the acid is selected from the group comprising water soluble organic mono- and polycarboxylic acids with 2 to 6 carbon atoms and optionally substituted by one or more hydroxy groups, inorganic acids and mixtures thereof.

11. A process according to claim 10 wherein the acid is selected from the group consisting of adipic acid, succinic acid, tartaric acid, malic acid, maleic acid, glutaric acid, citric acid and mixtures thereof.

* * * * *